United States Patent [19]

Ochiai et al.

[11] 4,437,775

[45] Mar. 20, 1984

[54] DOT PRINTER HEAD

[75] Inventors: Kuniaki Ochiai, Mishima; Masami Horii; Hidekazu Ishii, both of Shizuoka, all of Japan

[73] Assignee: Tokyo Electric Co., Ltd., Tokyo, Japan

[21] Appl. No.: 403,284

[22] Filed: Jul. 29, 1982

[30] Foreign Application Priority Data

Aug. 14, 1981 [JP] Japan ..... 56-120894[U]

[51] Int. Cl.[3] ..... B41J 3/12

[52] U.S. Cl. ..... 400/124; 101/93.05

[58] Field of Search ..... 400/124; 101/93.05

[56] References Cited

U.S. PATENT DOCUMENTS

| | | | |
|---|---|---|---|
| 3,672,482 | 6/1972 | Brumbaugh et al. | 400/124 |
| 3,994,381 | 11/1976 | Hebert | 400/124 |
| 4,143,979 | 3/1979 | Boyd | 400/124 |
| 4,244,658 | 1/1981 | Mori | 400/124 |

*Primary Examiner*—Paul T. Sewell

*Attorney, Agent, or Firm*—Oblon, Fisher, Spivak, McClelland & Maier

[57] ABSTRACT

In this invention, the rear ends of the printing needles are bent and prevented from being pulled out by being embedded in needle caps. The needle caps are flat, and the longitudinal directions of the cross-sections of the needle caps are coincident with the radial direction of the printer. The rear ends of the needles are arranged in annular form. Each needle cap is slidably held by a guide body. Lateral displacement of the needles is prevented, and the contacting area between the needle caps and an armature of an electromagnet is reduced. A ring connecting the rear ends of the needles is reduced in size, providing a margin at both sides of the needle cap and armature. The bending amount of the needle is reduced, and the sliding resistance of the needle is reduced, which improves the durability of the needles and the needle guides. Also a small armature may be used, thereby saving on the consumption of power in that an electromagnet of small capacity may be used. The device as a whole is compact, and high-speed printing can be effected.

5 Claims, 7 Drawing Figures

DOT PRINTER HEAD

BACKGROUND OF THE INVENTION

1. Field of the Invention

This invention relates to dot printers, and more particularly to a dot printer head.

2. Description of the Prior Art

In conventional dot printer heads, rear ends of needles are connected to electromagnets arranged radially. The needles are bent and slidably inserted in a plurality of needle guides, and the top ends of the needles are aligned at equal pitch. In this construction, the needle and needle guide are liable to abrasion due to the sliding action of the bent needle. In order to reduce the abrasion, the amount by which the needle is bent must be reduced and the bending load must be reduced. If a ring connecting the rear ends of the needles is used for this purpose, the inner portion of an armature in the electromagnet used to strike the rear end of an associated needle may interfere with other adjacent armatures. Therefore, the reduction of needle bending amount by this technique is limited. Since the rear end of the needle extends in both the axial direction, and the radial direction and since the rear end of the needle is displaced laterally about the needle guide at the rearmost portion as a fulcrum, the armature and the needle cap (which is fixed at rear end of the needle) must have large contacting area therebetween. This results in enlargement of the ring connecting the rear ends of the needles so as to prevent interference between the adjacent armatures, which further increases the difficulty of reducing the bending amount of the needle. If the area of the top end of the armature is increased, the amount of inertia is greatly increased, and the electromagnet must be made large. Such increase in the size of the electromagnet means that high-speed performance cannot be expected and that consumption of power increases.

In order to reduce lateral displacement of the needle, the distance between the needle guide at the rearmost portion and the needle cap may be reduced, and the spring used to urge the needle in the reset direction may have a large spring constant. However, use of a spring having a large spring constant makes the needle fly, whereby good printing is not obtained.

PURPOSE OF THE INVENTION

A first object of this invention is to reduce the bending amount of the needle with respect to the vertical line and to decrease the sliding resistance.

A second object of this invention is to prevent lateral displacement of the needle cap and to enable reduction of the contacting area of the needle cap with the armature.

A third object of this invention is to effect high speed needle driving using an electromagnet of small capacity.

Other objects will become apparent in the following description of a preferred embodiment.

DETAILED DESCRIPTION OF THE INVENTION

Figure 1:
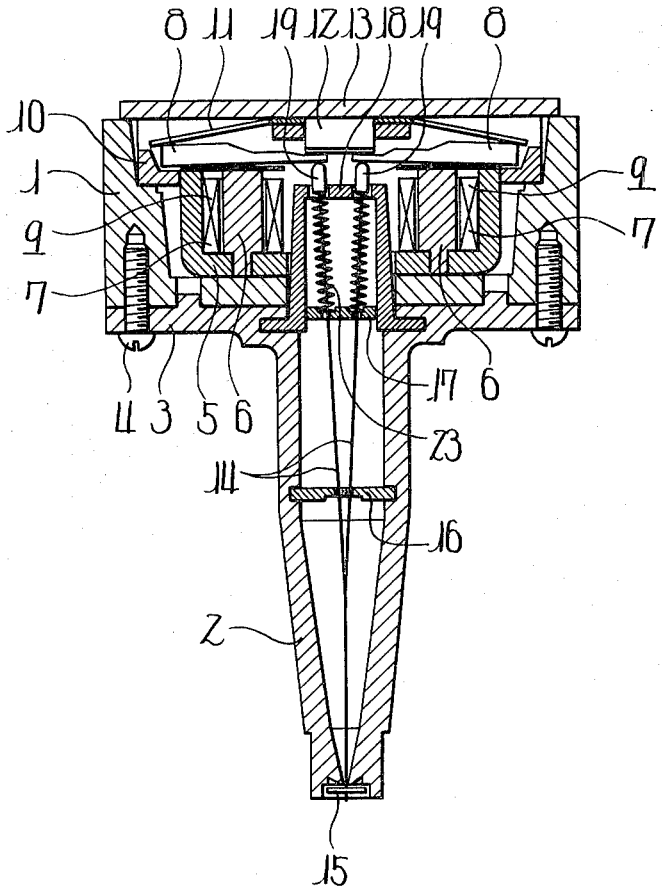
FIG. 1 is a side view in vertical section of a dot printer head.

An embodiment of this invention will now be described referring to the accompanying drawings. An annular base 1 and a flange 3 of a guide holder 2 are connected by screws 4. A yoke 5 is fixed to the base 1 and provided with a plurality of electromagnets 9 arranged on an annular line. Each electromagnet 9 comprises a core 6, a coil 7 wound around the core 6, and an armature 8. An armature guide 10 is held on the base 1, and the armature 8 is movably held on the armature guide 10. A cover 13 is connected to the opening end of the base 1, and the cover 13 holds a leaf spring 11 to urge the armature 8 in the reset direction and a stopper 12 to determine the reset position of the armature 8.

Figure 2:
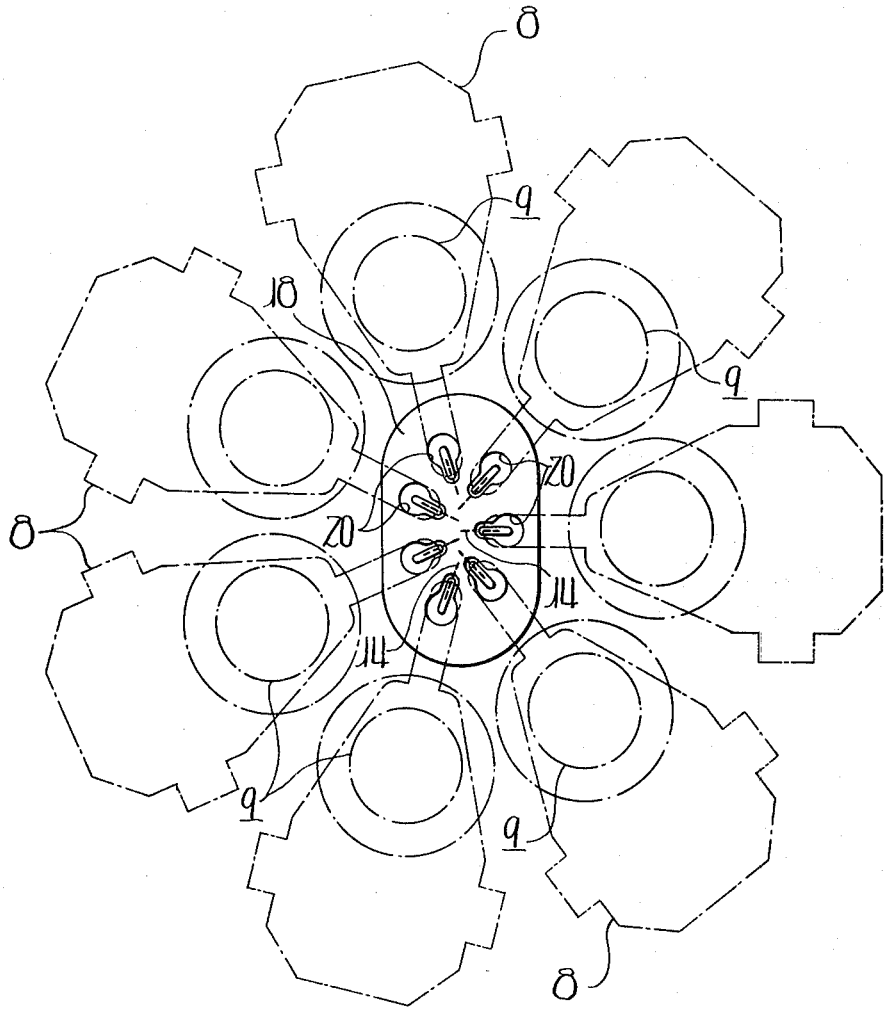
FIG. 2 is an enlarged rear elevation illustrating the relation of a guide body and a needle cap.
Figure 3:
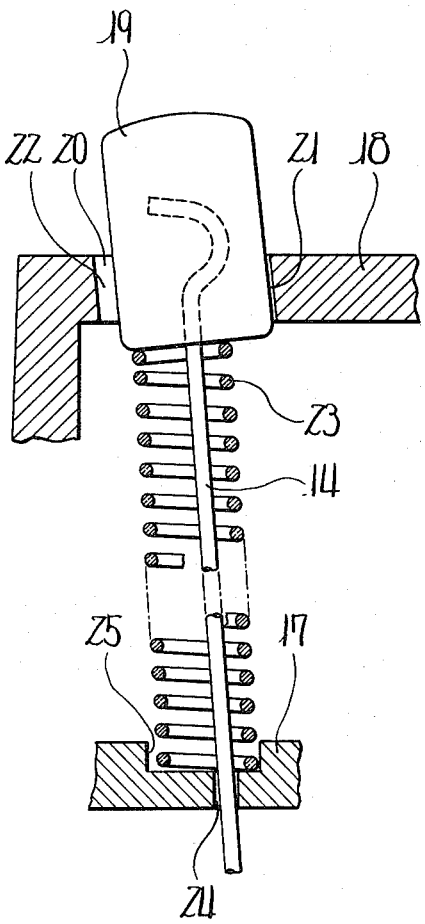
FIG. 3 is an enlarged side view in vertical section illustrating the relationship of a needle to its needle spring rest and the guide body.
Figure 4:
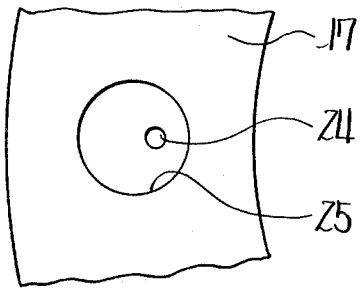
FIG. 4 is an enlarged rear elevation of part of a needle spring rest.
Figure 5:
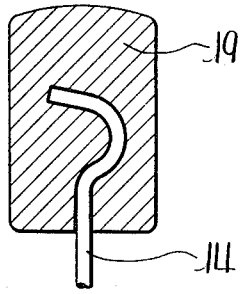
FIG. 5 is an enlarged side view in vertical section illustrating the connection between the needle cap and the needle.
Figure 6:
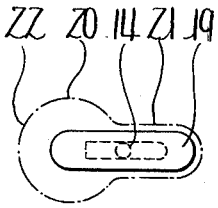
FIG. 6 is an enlarged rear elevation illustrating the relation between the needle cap and a guide hole in the guide body.

Needle guides 15, 16 which guide a plurality of needles 14 and arrange the top ends of the needles in a line, a needle spring rest 17, and a guide body 18 are attached to the guide holder 2. The needles 14 are bent in the same plane, and the bent portions are prevented from being pulled out by being embedded in needle caps 19 each having arcuate end. Each needle cap 19 is constituted in flat form, and the longitudinal direction of its cross-section coincides with the plane in which the associated needle 14 is bent. A guide hole 20 which slidably receives each needle cap 19 is formed in the guide body 18. As clearly seen in FIG. 2 and FIG. 6, the guide hole 20 comprises an oval hole 21 which receives the inner side of the needle cap 19 so that longitudinal direction of the cross-section of the needle cap 19 coincides with the radial direction and a circular hole 22 which surrounds the outer side of the needle cap 19. The oval hole 21 and the circular hole 22 are communicated, and the diameter of the circular hole 22 is greater than that of a needle spring 23. The needle spring 23 surrounds the needle 14 between the needle cap 19 and the needle spring rest 17. A concave seat 25 which supports the needle spring 23 is formed in the needle spring rest 17, and a hole 24 which receives the needle 14 is formed in the concave seat 25.

Figure 7:
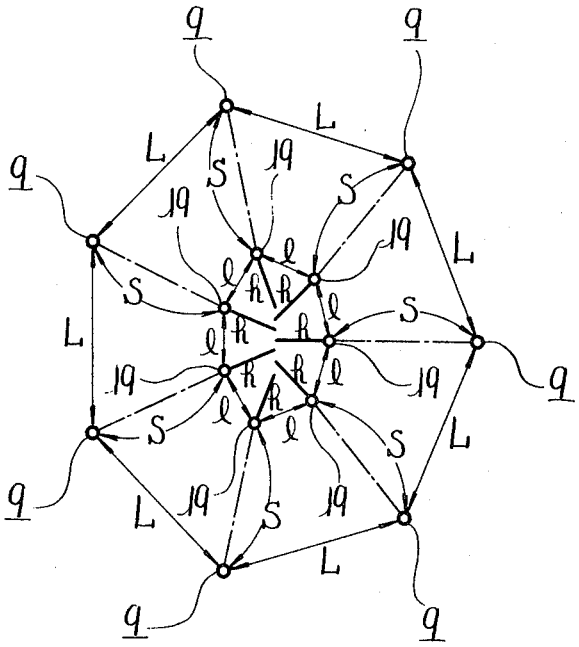
FIG. 7 is a schematic diagram illustrating the relation between the electromagnet, the needle cap and the needle.

A plurality of the needles 14 have the same length. As seen in a schematic diagram in FIG. 7 illustrating the relation of the electromagnets 9, the needle caps 19, and the top ends of the needles 14, the centers of the coils 7 of the electromagnets 9 are spaced at regular intervals (L) and the top ends of the needles 14 are equi-distantly spaced in a line. The distances (l) between the needle caps 19 are made equal by shifting the needle cap 19 from a plane passing through the line connecting the centers of the coils 7 with the top end of the needles 14, and the distances (S) between the needle cap 19 and center of the coil 7 are made equal.

In the above described construction, printing is effected by energizing the electromagnet 9, striking the needle cap 19 using the armature 8, and making the needle 14 fly. The needle cap 19 is flat and arranged so that the longitudinal direction of the cross-section coincides with the radial direction. The needle cap 19 is held on the guide body 18 and prevented from lateral displacement. Accordingly, the contact area between the needle cap 19 and the armature 8 can be reduced. Therefore, the inner end of the needle cap 19 and the armature 8 has margin on both sides of the adjacent direction. The seat 25 of the needle spring rest 17 is shifted outwards with respect to the hole 24 for the needle 14 so that interference between adjacent needle springs 23 is prevented. In addition to the fact that there is an equal distance (l) between the needle caps 19, all of the needle caps 19 may be positioned towards the center of the base 1, which means that the bending amount (h) of the needles 14 can be reduced. This in turn means that the resistance of the needle 14 against the needle guides 15, 16 is reduced. Accordingly, durability of the needle guides 15, 16 and the needles 14 is improved. Furthermore, the small armature 8 can be driven by an electromagnet 9 of small capacity, which means that power is saved, that the device is made compact, and that high-speed printing is possible.

According to the invention, the size of the ring connecting the rear ends of the needles 14 may be reduced. Accordingly, the sliding resistance of the needles 14 may be reduced, and a needle spring 23 having a small spring constant may be used. Therefore, the strokes of the needle 14 are enlarged, and clear printing can be effected.

The invention as above described has various beneficial effects. The ring connecting the rear ends of the needles can be reduced in size providing margin between adjacent needle caps. Lateral displacement of the needle caps is prevented by the guide body. The contacting area between the needle caps and the armature is reduced. Furthermore, the ring connecting the rear ends of the needles is reduced in size, which reduces the bending amount and the sliding resistance of the needles and which improves the durability of the needles and the needle guides. Moreover, a small armature may be used, thereby saving on the consumption of power by permitting the use of an electromagnet of small capacity and permitting the device to be made compact, which in turn permits high-speed printing to be effected.

We claim:

1. A dot printer head comprising:

(a) a plurality of electromagnets arranged in annular form around the central axis of the dot printer head, each of said plurality of electromagnets having an armature operatively associated therewith;

(b) a plurality of flat needle caps, each of which has an elongated cross-section in the radial direction of the dot printer head, one of said needle caps being associated with each of said plurality of electromagnets in position to be driven by the armature thereof in the direction of the axis of the dot printer head;

(c) a plurality of needles, the non-working end of each of said plurality of needles being bent in the radial direction of the dot printer head and embedded in an associated one of said needle caps, the working ends of said plurality of needles being aligned with one another and equi-distantly spaced from one another in a plane which includes the central axis of the dot printer head;

(d) a guide body which receives said plurality of needles, said guide body having a plurality of guide holes in a surface thereof perpendicular to the axis of the printer head, each of said guide holes being composed of an oval portion which extends in the radial direction of the dot printer head and which slidably receives one of said needle caps and a circular portion disposed radially outwardly of the oval portion, the circular portion of each guide hole being in communication with the oval portion of each guide hole and the diameter of the circular portion of each guide hole being greater than the width of the oval portion of each guide hole and greater than the diameter of the needle spring recited in subparagraph (f);

(e) a needle spring rest mounted in said guide body perpendicularly to the central axis of the dot printer head, said needle spring rest having a plurality of guide holes therein each of which slidably receives and guides one of said needles; and (f) a needle spring surrounding each of said needles and bearing at one end against said needle spring rest and at the other end against one of said plurality of needle caps, each of said needle springs serving to urge the associated one of said needle caps towards the associated one of said armatures.

2. A dot printer head as recited in claim 1 wherein:

(a) a plurality of concave spring seats are formed in said needle spring rest, one of said spring seats receiving the associated end of each of said needle springs;

(b) the associated guide hole is formed in the bottom of each of said spring seats; and (c) the associated guide hole is spaced radially inwardly from the central axis of the associated needle spring, whereby the axis of each of said needles is inclined radially inwardly in the direction toward the working end of said needle relative to the axis of the associated needle spring.

3. A dot printer head as recited in claim 1 wherein said needle caps are positioned at regular intervals around the central axis of the dot printer head.

4. A dot printer head as recited in claim 1 wherein the amount and fashion in which each of said needles is bent inside the associated one of said needle caps is uniform.

5. A dot printer head as recited in claim 1 wherein the radial distance from the central axis of each of said plurality of electromagnets to the associated needle cap is uniform.

* * * * *